US006742222B2

(12) United States Patent
Furr-Britt et al.

(10) Patent No.: US 6,742,222 B2
(45) Date of Patent: Jun. 1, 2004

(54) DUAL HANDLE ATTACHMENT FOR AN APPLIANCE

(76) Inventors: Tonja L. Furr-Britt, P.O. Box 894, Rockwell, NC (US) 28138; Grover A. Britt, Jr., 4580 Richfield Rd., Richfield, NC (US) 28137

( * ) Notice: Subject to any disclaimer, the term of this patent is extended or adjusted under 35 U.S.C. 154(b) by 35 days.

(21) Appl. No.: 10/287,479

(22) Filed: Nov. 5, 2002

(65) Prior Publication Data

US 2004/0083579 A1 May 6, 2004

(51) Int. Cl.[7] ..... E05B 7/00
(52) U.S. Cl. ..... 16/430; 16/438
(58) Field of Search ..... 16/421, 430, 437, 16/110.1, 431, 438; 74/543, 551.1, 551.9; D32/34; D8/300, 303, 306, 315

(56) References Cited

U.S. PATENT DOCUMENTS

| | | | | |
|---|---|---|---|---|
| 1,014,776 | A | 1/1912 | Rubel | |
| 1,267,329 | A | 5/1918 | Merithew | |
| 1,320,070 | A | * 10/1919 | Ledig | 403/191 |
| 1,692,137 | A | 11/1928 | Orr | |
| 1,936,366 | A | 11/1933 | Riebel, Jr. et al. | |
| 2,819,485 | A | 1/1958 | Sparklin | |
| 3,097,890 | A | 7/1963 | Doyle | |
| 3,203,707 | A | 8/1965 | Anderson | |
| 3,204,272 | A | 9/1965 | Greene et al. | |
| D209,810 | S | 1/1968 | Bowers, Jr. et al. | |
| D212,711 | S | 11/1968 | McLane | |
| 3,758,914 | A | 9/1973 | Nupp et al. | |
| 4,662,026 | A | 5/1987 | Sumerau et al. | |
| 4,715,084 | A | 12/1987 | Jacob et al. | |
| 4,720,890 | A | 1/1988 | Jacob | |
| D294,988 | S | 3/1988 | Goodrich | |
| 5,016,315 | A | 5/1991 | Bledsoe et al. | |
| 5,109,568 | A | 5/1992 | Rohn et al. | |
| 5,165,144 | A | * 11/1992 | Nisenbaum | 16/421 |
| D353,917 | S | 12/1994 | Hoekstra et al. | |
| 5,507,067 | A | 4/1996 | Hoekstra et al. | |
| D374,318 | S | 10/1996 | Meelen | |
| 5,564,160 | A | 10/1996 | Luebbering | |
| D393,514 | S | 4/1998 | Hadley et al. | |
| 5,996,175 | A | 12/1999 | Fusco | |
| 6,012,200 | A | 1/2000 | Murphy et al. | |
| D429,395 | S | 8/2000 | Kiern et al. | |
| D431,335 | S | 9/2000 | Mehaffey et al. | |
| 6,196,562 | B1 | * 3/2001 | Zhuang | 280/47.38 |
| 6,336,254 | B1 | * 1/2002 | Graff et al. | 16/422 |
| D453,596 | S | 2/2002 | Farone et al. | |

FOREIGN PATENT DOCUMENTS

| | | |
|---|---|---|
| CA | 1277812 | 12/1990 |
| DE | 3140131 | 4/1983 |

* cited by examiner

*Primary Examiner*—Gary S. Hartmann
(74) *Attorney, Agent, or Firm*—Richard C. Litman

(57) ABSTRACT

A dual handle attachment for a floor appliance, e.g., vacuum cleaner, large push broom, mop, squeegee, etc., allows a user of the appliance to manipulate or maneuver the appliance using generally symmetrical upper body, arm, wrist, and hand forces and movements, thereby obviating the need for asymmetrical twisting and the greater strength required to manipulate such a device using only a single arm and hand. The present attachment comprises a single central bracket which attaches to the conventional single handlebar of such an appliance, with a left and a right handgrip adjustably extending from the central bracket. The two handgrips may be pivotally adjusted by the user as desired, and may be interchanged for handgrips having different shapes or configurations as desired. One embodiment may be removably secured to the appliance, with another embodiment providing for permanent attachment as an integral part of the appliance at the time of manufacture.

19 Claims, 5 Drawing Sheets

DUAL HANDLE ATTACHMENT FOR AN APPLIANCE

BACKGROUND OF THE INVENTION

1. Field of the Invention

The present invention relates generally to handles and similar attachments and extensions for various devices, and more particularly to a dual handle attachment for various types of powered and manually operated floor appliances. The present invention comprises a pair of generally symmetrically disposed handgrips which extend from a central fixture or attachment, which is in turn removably or permanently attached to the appliance. The present dual handle attachment is particularly well suited for use with vacuum cleaners, but may be fitted to a number of other floor appliances as well, such as push brooms, mops, buffers, etc.

2. Description of the Related Art

Even relatively light physical labor can be difficult for some persons afflicted with various illnesses and diseases. While everyone suffers from some temporary infirmity (common cold or the flu, a muscle sprain, etc.) which may make it difficult or impossible to perform physical labor for some relatively short period of time, our aging population tends to suffer from more chronic ailments which affect their ability to perform physical tasks.

Chronic arthritis, carpal tunnel problems in the wrist(s), cardiac problems, etc. have taken their toll on a large number of people, particularly those in their later years. Many such persons would nevertheless be capable of independent living, if it were not for the need to perform certain physical tasks which would otherwise be of no great consequence. However, persons suffering from various physical disabilities, such as those noted above, are often greatly restricted when it comes to otherwise routine tasks, such as housecleaning, vacuuming, and the like.

One of the major reasons that persons may have difficulty with such tasks, is that the typical floor appliance (vacuum cleaner, etc.) has only a single centrally positioned handle at the upper end of a column or shaft. (This same general configuration holds true for manually operated appliances such as push brooms, mops, floor squeegees, and similar devices as well.) Such appliances are typically operated by manipulating the appliance using one hand on the single handgrip at the upper end of the handle, particularly in the case of vacuum cleaners and other powered appliances. For a person with limited upper body physical strength or mobility, this need for asymmetric manipulation of the appliance can be difficult or impossible, depending upon the physical limitations of the appliance user and the manipulation required. For example, many persons with recent heart surgery are encouraged to engage in mild exercise, but the asymmetric stress of pushing a vacuum cleaner using only one arm, can stress the stitches remaining after surgery and possibly reinjure the surgical site.

Persons with chronic arthritis, muscular weakening, etc. are also limited in their abilities to use single handled appliances. While they may otherwise be capable of caring for themselves and maintaining a household, certain otherwise routine chores require them to seek outside assistance. Many, if not most, such persons are in their later years, and are living on a fixed retirement income. This can make it financially difficult for such persons to obtain outside help for such otherwise routine chores, and yet these persons are quite capable of living independently, if they could only have some limited assistance with certain occasional chores, particularly such household tasks as would otherwise require mild exertion and asymmetric manipulation and orientation of the body, using only one hand and arm.

The present invention provides a solution to the above problem by means of a dual handle attachment for vacuum cleaners and other types of powered and manually operated floor appliances (heavy push brooms, mops, squeegees, etc.). The present invention comprises different embodiments providing for either removable attachment, or permanent attachment to an appliance. The removable device includes a clamp which removably attaches to the single shaft or column of the appliance, with a pair of generally symmetrically disposed (but arcuately adjustable) handles extending from the clamp. In another embodiment, the handle attachment is permanently affixed to the central shaft of the appliance. Both embodiments preferably provide for the adjustment and interchangeabilty of the two handles.

A discussion of the related art of which the present inventors are aware, and its differences and distinctions from the present invention, is provided below.

U.S. Pat. No. 1,014,776 issued on Jan. 16, 1912 to Simon L. Rubel, titled "Vacuum Cleaner," describes a manually actuated device in which vacuum is created by manipulating a telescoping pump. A single, axially centered handle is used for manipulating the pump, with a second handle extending radially from the column of the device. The user holds the single radial handle with one hand, and pumps the central axial handle with the other to manipulate the pump. The Rubel device clearly teaches away from the present invention, as Rubel requires that one hand grip the axial pump handle. Thus, only one other hand may be used to grip the radially offset handle to hold and guide the apparatus itself.

U.S. Pat. No. 1,267,329 issued on May 21, 1918 to Jerry J. Merithew, titled "Vacuum Sweeper," describes a hand powered vacuum cleaner, with vacuum provided by a laterally disposed hand crank. As in the case of the Rubel manually powered vacuum cleaner described immediately above, the Merithew device cannot be maneuvered and guided using both hands and arms in a generally symmetrical posture, due to the single handle for operating the vacuum mechanism and the other single handle for maneuvering the device. The Merithew device requires that the operator use one hand to provide the vacuum power, i.e., turn a crank, with only one hand remaining free to maneuver and guide the device.

U.S. Pat. No. 1,692,137 issued on Nov. 20, 1928 to William V. Orr, titled "Suction Cleaning Device," describes an electrically powered vacuum cleaner of generally conventional configuration, having a single, centrally disposed handle or shaft upon which the vacuum bag is held or suspended. The upper end of the handle or shaft includes a single handgrip thereon. Orr makes no suggestion or teaching of any form of bifurcated, dual handle attachment for maneuvering and manipulating his vacuum cleaner, either in a removably or permanently attached embodiment.

U.S. Pat. No. 1,936,366 issued on Nov. 21, 1933 to Frederick Riebel, Jr. et al., titled "Vacuum Cleaner Handle Attaching Means," describes an attachment for a tubular handle and duct for a vacuum cleaner. The single elongate handle acts as an air nozzle for the vacuum cleaner, as well as serving as the handle for the device. No dual handle attachment is disclosed by Riebel, Jr. et al.

U.S. Pat. No. 2,819,485 issued on Jan. 14, 1958 to Charles H. Sparklin, titled "Movable Vacuum Cleaner Structure," describes a relatively large and bulky assembly having an inverted, generally U-shaped handle structure. Two telescoping elements are provided, which telescope into mating lower tubes. However, they are joined by a single handgrip across their center juncture. This is essentially opposite the present handle structure, with its single central shaft and two handgrips branching therefrom. Sparklin does not provide laterally opposed handgrips for the simultaneous use of both hands, as does the present invention.

U.S. Pat. No. 3,097,890 issued on Jul. 16, 1963 to Patrick E. Doyle, titled "Adjustable Handle For Floor Machines," describes a handle assembly for a floor buffer or the like. The handle is angularly affixed to the lower portion of the machine by an adjustment mechanism, comprising a series of teeth which engage mating teeth on the base structure. A lever is used to disengage the teeth for adjustment, with the teeth locking the handle at the new angle as desired. The Doyle apparatus has no relationship to the present invention, other than the disclosure of a floor buffer having permanently installed laterally disposed handles in the form of a T configuration, as is known in the floor buffer art.

U.S. Pat. No. 3,203,707 issued on Aug. 31, 1965 to Erik A. Anderson, titled "Collapsible Manipulating Handle For Floor Treating Machine," describes a handlebar assembly having two laterally spread arms which attach to each side of the relatively wide base of the machine, and converge to be disposed closely adjacent one another at their upper handle end. Left and right laterally opposed handles extend from the sides of the upper end of the handlebar assembly. The assembly can fold about a generally centrally disposed crossmember, which serves as a hinge axis. The Anderson handgrip arrangement more closely resembles that of the floor buffer of the Doyle apparatus discussed immediately above, than it does the present invention. No pivotally mounted, separately adjustable handles having parallel pivotal axes is provided by Anderson for his machine.

U.S. Pat. No. 3,204,272 issued on Sep. 7, 1965 to Frederic S. Greene et al., titled "Floor Treating Device With Articulated Handle," describes a floor buffer or the like having a handle configuration much like that of the Anderson '707 U.S. Patent discussed immediately above. However, rather than having a laterally extending handgrip to each side of the upper end of the handle assembly, Greene et al. provide an inverted, generally U-shaped handle configuration with left and right handgrips across the upper lateral portion thereof. No separably adjustable, pivotally attached handgrips having parallel pivotal axes is provided by Greene et al. for their handle assembly.

U.S. Pat. No. 3,758,914 issued on Sep. 18, 1973 to Donald L. Nupp et al., titled "Vacuum Cleaner With Movable Handle Structure," describes a vacuum cleaner having a single elongate handle which is pivotally attached to the upper end of the body of the device. The handle may be pivoted to extend upwardly beyond the body, to provide sufficient length to use the device as a floor vacuum, or may be pivoted to a position parallel to the back of the device for using the device as a hand held vacuum. The Nupp et al. handle has only a single handgrip which is disposed generally concentrically with the upper end of the single handlebar. No laterally opposed, independently adjustable handgrips are provided with the Nupp et al. vacuum cleaner and handle structure.

U.S. Pat. No. 4,662,026 issued on May 5, 1987 to William R. Sumerau et al., titled "Convertible Vacuum Cleaner Handle," describes a handle assembly more closely resembling that of the Nupp et al. vacuum discussed immediately above, than the present invention. The primary differences between the Sumerau et al. handle and the Nupp et al. handle, are that (1) the Sumerau et al. handle pivots about a laterally disposed pivot point, rather than a vertically disposed pivot, as in the Nupp et al. vacuum; and (2) the Sumerau et al. handle telescopes, whereas the Nupp et al. handle does not. Neither has a pair of pivotally adjustable handgrips having parallel pivot axes, as does the present invention.

U.S. Pat. No. 4,715,084 issued on Dec. 29, 1987 to Gernot Jacob et al., titled "Hand Vacuum Cleaner," describes a vacuum cleaner assembly with a detachable tubular suction element and handle extending from the opposite side from the suction element. Jacob et al. provide a tangential cam locking mechanism to secure the tubular elements to the body portion of their vacuum cleaner. No laterally symmetrical, dual handgrips having parallel pivotal axes, are provided by Jacob et al.

U.S. Pat. No. 4,720,890 issued on Jan. 26, 1988 to Gernot Jacob, titled "Vacuum Cleaner Handle," describes a handle assembly having a single loop shaped handgrip with a cord reel attached thereto. Several embodiments are disclosed, with the cord reel in various planes. However, no dual handgrip arrangement is disclosed by Jacob in his '890 U.S. Patent.

U.S. Pat. No. 5,016,315 issued on May 21, 1991 to Susan G. Bledsoe et al., titled "Floor Cleaning Device With Improved Handle Grip," describes a handle assembly comprising a single tubular column or shaft with a loop shaped handle attached to the distal or upper end thereof. Bledsoe et al. appear to have put some thought into the ergonomic design of their handle assembly, but the device nevertheless includes only a single handgrip and cannot be manipulated using symmetrical forces from the upper body, arms, and hands of the user, as can the present handle attachment invention.

U.S. Pat. No. 5,109,568 issued on May 5, 1992 to Dean R. Rohn et al., titled "Handle Assembly For A Vacuum System Cleaning Tool," describes a loop type handle attachment which is installed between the flexible portion of a vacuum hose, and the rigid tubular portion which may be attached thereto. As in other loop type handle attachments which attach to a single tubular component, the Rohn et al. handle comprises only a single loop with a single handgrip and cannot be gripped by both hands.

U.S. Pat. No. 5,507,067 issued on Apr. 16, 1996 to Peter Hoekstra et al., titled "Electronic Vacuum Cleaner Control System," describes a relatively complex electronic control system for a vacuum cleaner, with the controls being contained within a loop type handle apparatus between the flexible and rigid tubular portions of a vacuum hose. The Hoekstra et al. handle thus more closely resembles the handle of the Rohn et al. '568 U.S. Patent, than it does the present invention with its dual handgrips extending from a single attachment component.

U.S. Pat. No. 5,564,160 issued on Oct. 15, 1996 to Gregory W. Luebbering, titled "Vacuum Cleaner Having Forwardly Curved Handle," describes a single elongate handle configuration for a vacuum cleaner appliance. The handle of the Luebbering vacuum cleaner is curved forwardly from its upright position, which reduces the floor space required for storing the vacuum cleaner. When the handle is extended generally horizontally, its curvature positions the distal hand grip end somewhat above the floor for easier maneuvering of the appliance. However, Luebbering does not provide any form of dual handle attachment to enable a user of the device to provide symmetrical forces to the appliance, and thereby eliminate asymmetric twisting forces to the body and reduce the force which would otherwise be required in using only one hand and arm, as Luebbering requires.

U.S. Pat. No. 5,996,175 issued on Dec. 7, 1999 to Edward Fusco, titled "Adjustable Vacuum Handle Construction," describes a handle attachment for the conventional single elongate tubular handle of a vacuum cleaner. The Fusco attachment comprises an external tube which is secured to the upper or distal end of the conventional handle, with a pivotally attached hand grip extending therefrom. The pivot axis is lateral to the conventional handle, thus placing the plane of rotation of the handgrip in the vertical plane, unlike the adjustment axes and planes of the present handle. More importantly, Fusco fails to provide a dual handle attachment for the conventional vacuum cleaner handle, with his single handle requiring the user to use only one hand and arm for operation.

U.S. Pat. No. 6,012,200 issued on Jan. 11, 2000 to John S. Murphy et al., titled "Upright Vacuum Cleaner," describes an essentially conventional vacuum cleaner apparatus having a single elongate handle extending therefrom. The single distal handgrip portion of the handle is ergonomically curved to fit the hand of a person using the device, and includes a hook for hanging the machine for storage. As with most related devices of the prior art, Murphy et al. do not disclose a dual handle configuration for their vacuum cleaner.

U.S. Pat. No. D-209,810 issued on Jan. 9, 1968 to John H. Bowers Jr. et al., titled "Vacuum Cleaner Hose Handle Or Similar Article," illustrates a design apparently for installing to the conventional flexible hose of a vacuum cleaner. No rigid handle for maneuvering the entire machine is provided by Bowers Jr. et al.

U.S. Pat. No. D-212,711 issued on Nov. 12, 1968 to Gerard J. McLane, titled "Vacuum Cleaner Handle Or Similar Article," illustrates a design apparently intended for installation to a conventional flexible hose for a vacuum cleaner, essentially in the manner of the Bowers et al. design discussed immediately above. The McLane handle includes a single curved handgrip extending therefrom, with an eye apparently for hanging the device for storage. No dual handgrips for maneuvering the machine by means of a single rigid handle extension, is disclosed by McLane, whereas such dual handgrips are a part of the present dual handle for appliances invention.

U.S. Pat. No. D-294,988 issued on Mar. 29, 1988 to Gordon W. Goodrich, titled "Handle Grip For A Vacuum Cleaner," illustrates a design apparently comprising an add-on attachment for the conventional single handlebar of a vacuum cleaner. The Goodrich handle grip design appears to form a closed loop, with one side having a straight tubular passage therein for installing over the end of the conventional vacuum cleaner handle. The Goodrich handle design closely resembles the single handgrip of the Bledsoe et al. '315 U.S. Patent, discussed further above. Goodrich is shown as a co-inventor in the Bledsoe et al. '315 U.S. Utility Patent.

U.S. Pat. No. D-353,917 issued on Dec. 27, 1994 to Peter Hoekstra et al., titled "Combined Vacuum Cleaner Handle And Wand," illustrates a design closely resembling the apparatus shown in FIG. 2 of the '067 U.S. Utility Patent to the same first inventor, discussed further above. The two illustrations depict a single loop type handle installed between the rigid tube and flexible hose portions of a vacuum cleaner hose assembly. No dual handle assembly is disclosed in either of the Hoekstra et al. U.S. Patents.

U.S. Pat. No. D-374,318 issued on Oct. 1, 1996 to Hans T. Meelen, titled "Hand Grip Portion For Vacuum Cleaner Tube," illustrates a design which more closely resembles that of the '711 U.S. Design Patent to McLane, discussed further above, than it does the present invention. Both the McLane and Meelen designs show an axially offset inlet and outlet tube portion, with a single curved handgrip in axial alignment with one of the tube portions and extending therefrom. No dual handgrip assembly is disclosed.

U.S. Pat. No. D-393,514 issued on Apr. 14, 1998 to Jeffery R. Hadley et al., titled "Wheelbarrow Handle Grip," illustrates a design having a tubular opening for fitting over the distal end of a handlebar for a wheelbarrow or the like, with a loop type handgrip extending from the tubular open end portion. While the Hadley et al. handgrip design is intended for use in pairs for installing upon the two handlebars of a wheelbarrow, the loop configuration more closely resembles that of the Bledsoe et al. '315 U.S. Utility Patent and the Goodrich '988 U.S. Design Patent, both of which are discussed further above, than it does the arcuately formed handgrip extension pairs of the present dual handle invention.

U.S. Pat. No. D-429,395 issued on Aug. 8, 2000 to Bruce M. Kiern et al., titled "Handle For A Vacuum Cleaner Or Other Device," illustrates a design comprising a closed loop and having a series of switches or buttons and a cord retaining hook thereon. The Kiern et al. handle design thus more closely resembles the handles of the Bledsoe et al. '315 U.S. Utility Patent and the Goodrich '988 U.S. Design Patent, both of which are discussed further above, than it does the arcuately formed handgrip extension pairs of the present invention. Kiern et al. do not disclose any means of attaching their handles in pairs to a vacuum cleaner or other appliance.

U.S. Pat. No. D-431,335 issued on Sep. 26, 2000 to David E. Mehaffey et al., titled "Vacuum Cleaner Handle," illustrates a design which apparently installs along the rigid tube and flexible hose of a vacuum cleaner assembly. The Mehaffey et al. design includes a closed loop handgrip, causing it to more closely resemble the handle of Rohn et al. '568 U.S. Utility Patent, discussed further above, than the present handle invention.

U.S. Pat. No. 453,596 issued on Feb. 12, 2002 to Richard C. Farone et al., titled "U-Shaped Handle For A Vacuum Cleaner," illustrates a design which is more accurately described as a closed loop having a bottom portion which attaches to the lower portion of an upright vacuum cleaner, with the two sides of the loop extending upwardly along each side of the canister and terminating in an upper closure from which a single handlebar extends. Only a single handgrip (shown in broken lines) is illustrated at the upper or distal end of the lower closed loop portion of the device.

German Patent Publication No. 3,140,131 published on Apr. 21, 1983 to Licentia GMBH, titled "Guide Piece For A Suction Hose Of A Vacuum Cleaner," describes (according to the drawings and English abstract) a handle for installing along the rigid tube and flexible hose portions of the assembly. The handle of the German Patent Publication includes a loop type handgrip extending therefrom, with a series of electronic controls therewith. As such, the handle of the German Patent Publication more closely resembles the handles of the Rohn et al. '568 U.S. Utility Patent and Hoekstra et al. '917 U.S. Design Patent, than it does the present invention.

Finally, Canadian Patent Publication No. 1,277,812 issued on Dec. 18, 1990 to Theodore R. Hayden, titled "Central Vacuum System Apparatus," describes a device for connecting between the rigid tube and flexible hose extensions of such a vacuum system. The Hayden apparatus includes a loop type handgrip extending from the tubular component, and further includes switching means for remotely controlling the vacuum motor. The device of the Hayden Canadian Patent Publication thus more closely resembles the handles of the Rohn et al. '568 U.S. Utility Patent, Mehaffey et al. '335 U.S. Design Patent, and '131 German Patent Publication, each of which has been discussed further above, than it does the present dual handle attachment for appliances.

None of the above inventions and patents, taken either singly or in combination, is seen to describe the instant invention as claimed. Thus a dual handle attachment for an appliance solving the aforementioned problems is desired.

SUMMARY OF THE INVENTION

The present invention comprises various embodiments of a dual handle attachment for floor appliances (e.g., vacuum cleaners, large and heavy push brooms, squeegees, and other powered and manually operated floor appliances). Typically, such floor tools have only a single handlebar or column extending therefrom, which requires the user or operator of the tool to manipulate the tool or appliance using asymmetrical forces from his or her upper body, arms, wrists, and hands.

The present dual handle attachment obviates this problem, by providing generally symmetrically disposed handgrips extending laterally from a central bracket which is attached to the central handlebar or column of the appliance or tool. The user of the tool can thus use both hands and apply substantially symmetrical forces and movements from his or her upper body, to manipulate the tool or appliance as desired. This is of great benefit for those persons who have limited upper body strength or flexibility, as they can produce essentially half the exertion using each arm, as would be required from conventional single arm manipulation of such devices.

Further versatility for the device is provided by pivotally attaching the two handgrips to the central bracket of the device. This allows the user of the device to position the two handgrips as desired, according to the needs of the user, in the event that the user tends to favor one side of the upper body more than the other. Friction means may be provided to secure the two handgrips at the desired positions, with the friction easily being overcome when adjustment is required. Handgrips of different configurations may be removably secured to the central bracket, as desired.

The present dual handle attachment may be formed as a removably attachable device which may be applied and removed as desired to any applicable tool or appliance. Alternatively, the present attachment may be installed upon the appliance at the time of manufacture of the appliance, with the handgrip bracket being a permanent and integral component of the elongate handle of the appliance or tool.

Accordingly, it is a principal object of the invention to provide a dual handle attachment for use with various types of powered and manually operated floor appliances, such as vacuum cleaners, large and heavy push brooms, squeegees, mops, and other such devices having single elongate handlebars for operation and manipulation.

It is another object of the invention to provide such a dual handle attachment which may be removably secured to an existing floor appliance, or which may be permanently installed to the floor appliance as an integral component thereof at the time of manufacture.

It is a further object of the invention to provide such a dual handle attachment having handgrips which are laterally disposed generally symmetrically from the central attachment bracket, with each of the handgrips being pivotally secured to the central attachment bracket upon parallel pivotal axes.

Still another object of the invention is to provide for the interchange of handgrips having different configurations to suit the needs of the user, as desired.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a dual handle attachment for powered or manual floor appliances, e.g. vacuum cleaners, large and heavy mops and push brooms, squeegees, etc. The present attachment enables a person using the appliance, to apply manipulative force symmetrically, rather than being restricted to only a single handgrip on the conventional single handlebar of the appliance.

Figure 1:
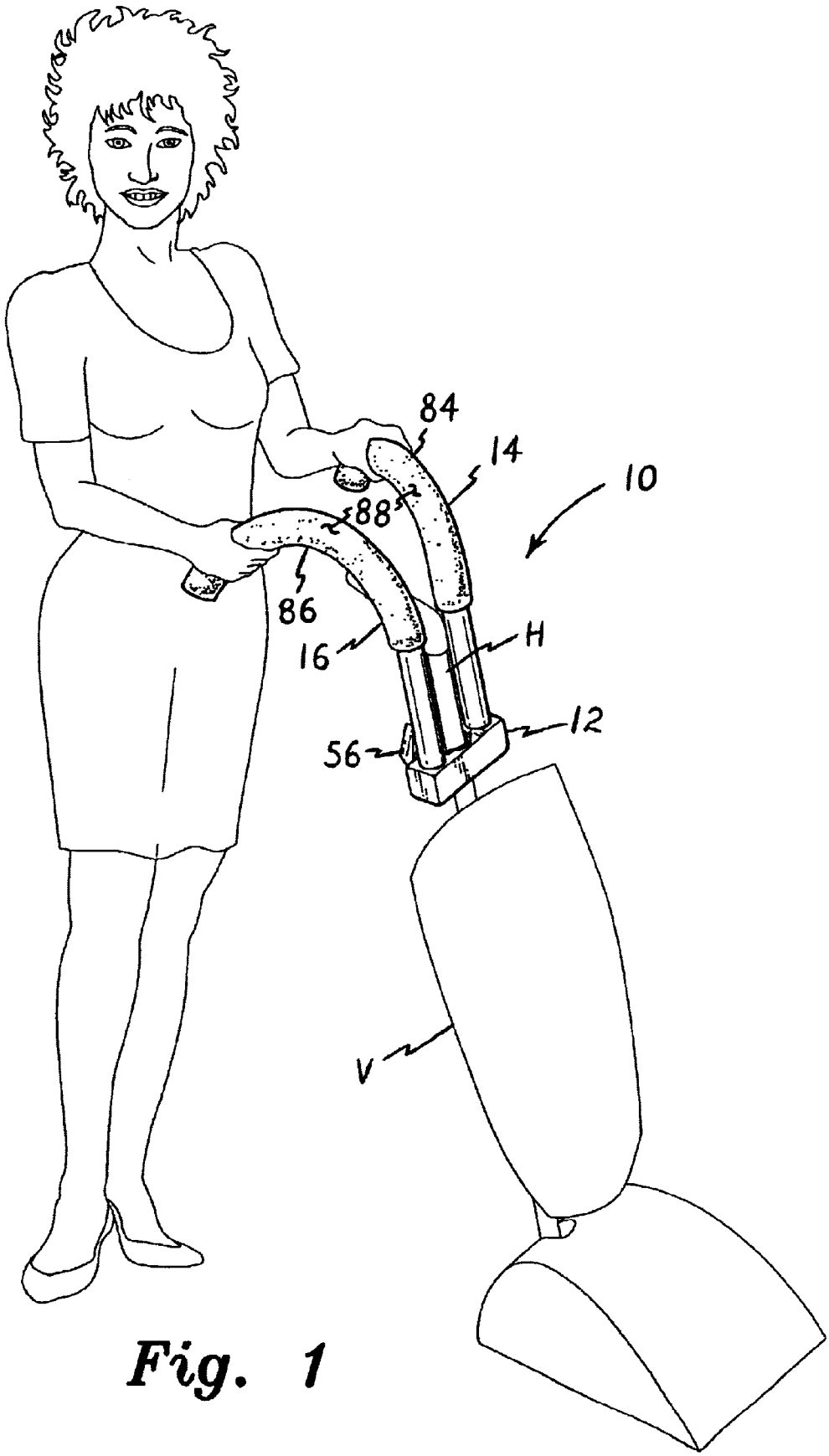
FIG. 1 is an environmental, perspective view of a dual handle attachment for an appliance according to the present invention, showing its operation and use.

FIG. 1 of the drawings provides an environmental perspective view of a first embodiment of the present attachment 10, removably secured to the single handlebar H of a vacuum cleaner V. The attachment 10 secures to the elongate handlebar H of the appliance by means of a single handlebar attachment bracket 12, from which a left and a right handgrip, respectively 14 and 16, extend. These handgrips 14 and 16 are preferably ergonomically shaped to optimize the grip of the user of the appliance, and minimize any undue wrist or other flexure which might lead to muscular and tendon stress and strain or other problems. However, the primary advantage of the present dual handle attachment 10, is that it allows the operator of the appliance to apply motive force symmetrically to the appliance, without need to twist or strain the upper portion of the body. This provides significant benefits for persons having limited upper body strength and/or mobility, by allowing the forces to be distributed evenly to the appliance from both sides of the upper body through both shoulders and arms.

Figure 2:
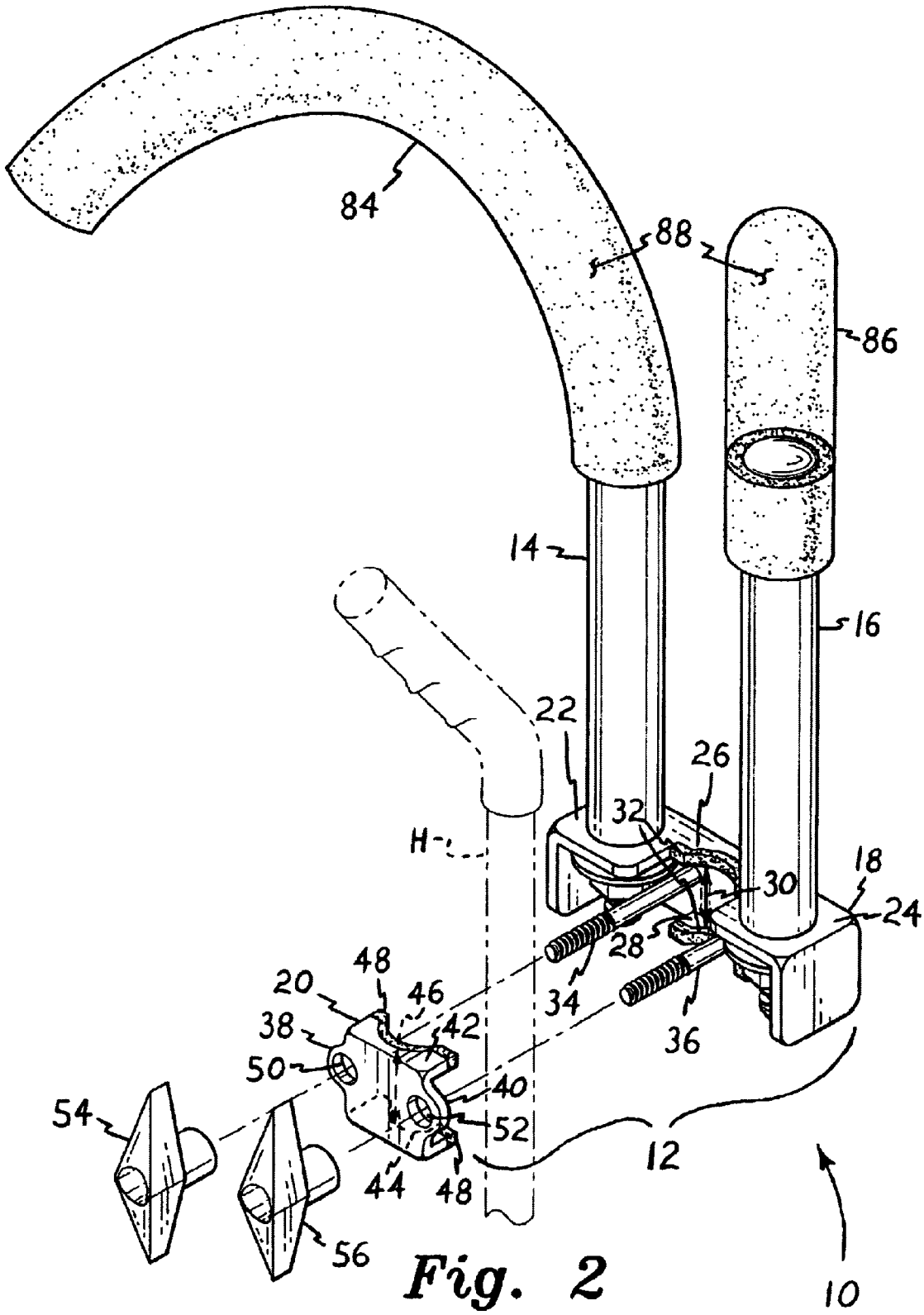
FIG. 2 is an exploded perspective detail view of the dual handle attachment of the present invention, showing details of the removable attachment means thereof.
Figure 3:
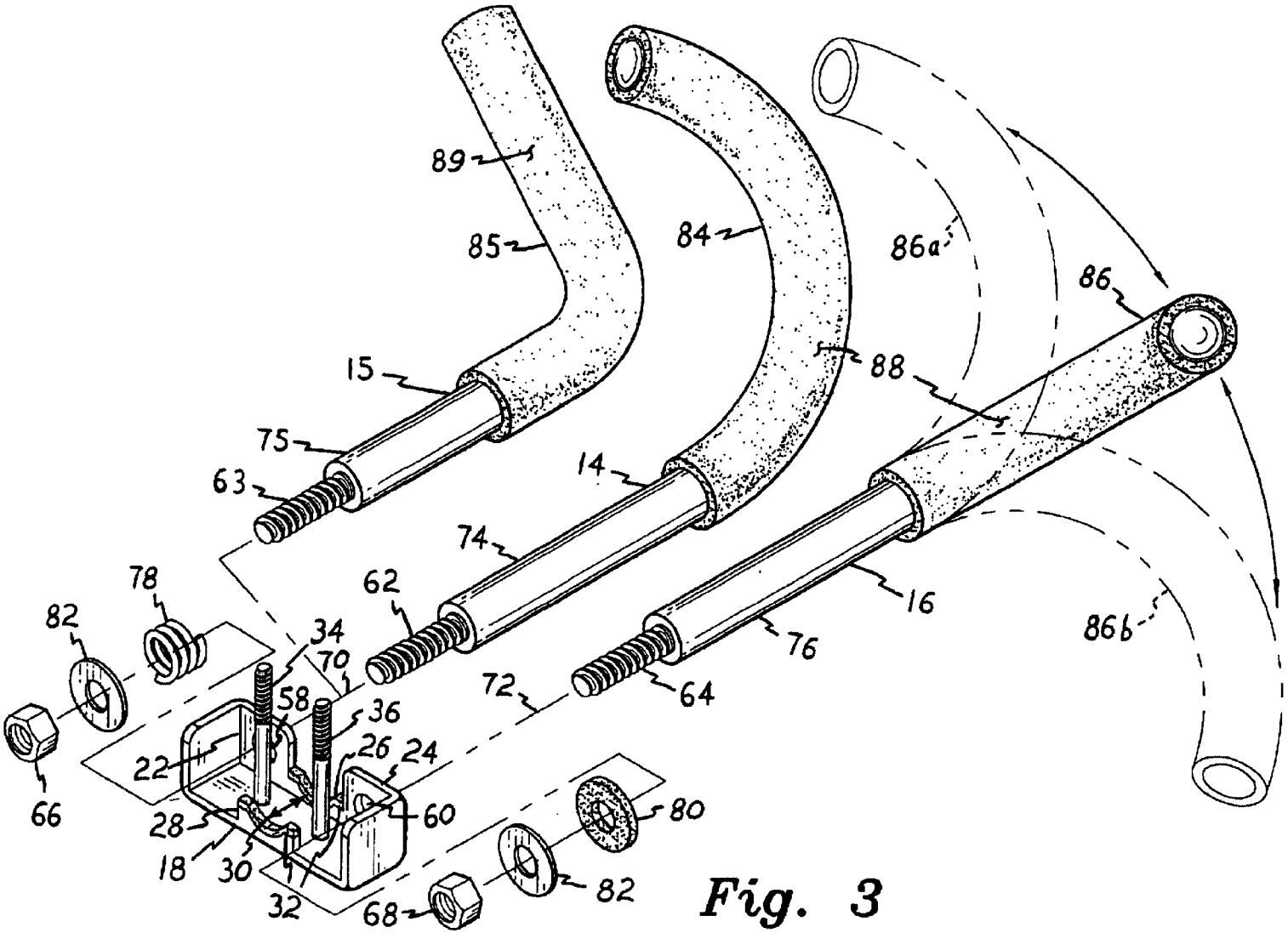
FIG. 3 is an exploded perspective detail view of one of the central bracket components of the device, showing the pivotal adjustment means and interchangeability of the handgrips thereof.

FIGS. 2 and 3 of the drawings illustrate various details of the present dual handle attachment 10. In the removable or detachable dual handle attachment 10 of FIGS. 2 and 3, the central attachment bracket comprises two components which clamp the appliance handle H therebetween. A handlebar clamp first portion 18 includes attachment fittings for the two handgrips 14 and 16, as well as attachments for securing a handlebar clamp second portion 20 to the first portion 18.

The handlebar clamp first portion 18 may be constructed as a weldment, casting, forging, etc. having a generally rectangular or open box-like configuration for strength, generally as shown, or other configuration as desired. The clamp first portion 18 includes a pair of mutually opposed, left and right handgrip mounting lugs, respectively 22 and 24, extending laterally therefrom, and serving as attachment points for the two handgrips 14 and 16. First and second appliance handlebar clamp jaws, respectively 26 and 28, are positioned between the two handgrip mounting lugs 22 and 24, and serve to grip one side of the appliance handlebar H when the handlebar clamp assembly is secured thereto. The two jaws 26 and 28 may be thought of as upper and lower jaws when the present attachment 10 is installed upon the handlebar H of an appliance, with the handlebar H in a generally upright or vertical position, and define a space or gap 30 therebetween in order to stabilize the installation of the assembly 10 on the appliance handlebar H. The two jaws 26 and 28 may include padding 32 thereon if so desired, to protect the finish of the appliance handlebar H.

A pair of parallel left and right clamp bolts, respectively 34 and 36, extend from between the two handgrip mounting lugs 22 and 24 and to each side of the first and second handlebar clamp jaws 26 and 28. These two bolts 34 and 36 essentially straddle the jaws 26 and 28 and the appliance handlebar H secured therein. The distal ends of the bolts 34 and 36 are conventionally threaded, to engage threaded fasteners discussed further below.

The handlebar clamp second portion 20 includes opposed left and right clamp bolt mounting lugs, respectively 38 and 40, extending laterally therefrom. First and second handlebar clamp jaws, respectively 42 and 44, are positioned between the two mounting lugs 38 and 40 and define a space or gap 46 therebetween, in much the same manner as the two clamping jaws 26 and 28 of the handlebar clamp first portion 18. Padding 48 may be applied to the two jaws 42 and 44 of the clamp second portion 20, in the same manner as the padding 32 which may be optionally applied to the jaws 26 and 28 of the clamp first portion 18, if so desired.

Each of the second clamp portion mounting lugs 38 and 40 includes a clamp bolt hole or passage, respectively 50 and 52, formed therethrough. These two passages 50 and 52 fit over the respective clamp bolts 34 and 36 which extend from the clamp first portion 18, with a pair of mating threaded fasteners 54 and 56 being installed upon the threaded ends of the two bolts 34 and 36 to secure the clamp second portion 20 to the clamp first portion 18 and securely capture and clamp the appliance handle H therebetween. The two fasteners 54 and 56 are preferably wing nut type fasteners, generally as illustrated in FIG. 2, in order to allow a person using the present dual handle attachment device 10 to install, remove, and reposition the assembly 10 upon an appliance handle H as desired without need for additional tools or equipment.

FIG. 3 more clearly illustrates the means for removably and adjustably securing the two handgrips 14 and 16 to the clamp assembly 12. Each handgrip mounting or attachment lug 22 and 24 includes a handgrip attachment passage or hole, respectively 58 and 60, formed therethrough. These two holes 58 and 60 provide for the insertion of the threaded attachment ends 62 and 64 of the two handgrips 14 and 16, with the handgrips 14 and 16 being removably secured to the first clamp portion 18 by mating threaded nuts (preferably self-locking nuts) 66 and 68. The two passages 58 and 60 are non-concentric and spaced laterally from one another, but their respective axes 70 and 72 are parallel, with the two straight bracket or clamp attachment end or shank portions 74 and 76 of the two handgrips 14 and 16 accordingly being positioned laterally offset but parallel to one another in a side by side relationship.

The two handgrips 14 and 16 preferably include some form of adjustable rotation resistance, allowing a person to adjust the handgrip 14 and 16 positions pivotally about their two attachment passages 58 and 60. The left handgrip 14 includes a coil spring 78 between the lock nut 66 and left handgrip mounting lug 22, with the spring compression being adjustable as desired by tightening or loosening the nut 66. The right handgrip 16 uses a friction washer 80 (rubber, etc.) captured between the right side nut 68 and right side handgrip mounting lug 24. Washers 82 are installed beneath each nut 66 and 68 to capture the rotation resistance element 78 or 80 thereunder. The above resistance elements are exemplary, and preferably the same type of element is used for both sides.

Each handgrip 14 and 16 is provided with a curved, bent, or otherwise shaped distal grip portion, respectively 84 and 86, ergonomically shaped to provide optimum comfort and secure grip for a person using the present attachment 10. A user may twist or rotate either or both of the handgrips 14 and 16 pivotally about their attachment points or passages 58 and 60 with the clamp first portion 18 to position the handgrips 14 and 16 as desired, as shown by the broken line positions 86*a* and 86*b* for the grip portion 86 of the right handgrip 16 of FIG. 3. Preferably, each of the handgrips 14 and 16 includes padding 88 disposed over at least the distal grip portions 84 and 86 thereof, for further comfort for the user.

The above means of pivotally securing the two handgrips 14 and 16 to the clamp first portion 18 also allows the handgrips 14 and 16 to be interchanged for different handgrips having a different configuration. FIG. 3 illustrates this, with a secondary handgrip 15 shown off to one side. The secondary handgrip 15 includes all corresponding features of the primary handgrips 14 and 16, i.e., a threaded attachment end shank 63, a straight handgrip attachment end portion 75, a bent or curved distal grip end 85, with padding 89 disposed thereover. However, the secondary handgrip 15 is configured differently from the primary handgrips 14 and 16, with a sharper, right angle bend in its distal grip portion 85. The differences between the primary handgrips 14 and 16 and the secondary handgrip 15 may be exaggerated for clarity in the drawing, with the secondary handgrip(s) 15 perhaps having a shape more closely resembling that of the primary handgrips 14 and 16.

Any handgrip configuration, e.g., handgrips 14, 15, or 16, may be quickly and easily exchanged with any other handgrip configuration, merely by removing the appropriate handgrip attachment nut 66 or 68, washer 82, and any rotational resistance components 78, 80, etc. installed therewith. The previously installed handgrip may then be withdrawn from its corresponding attachment passage 58 or 60, and the different handgrip installed therein. The previously removed nut, washer, and rotation resistance element are reinstalled upon the threaded attachment end of the new or different handgrip, with the nut tightened or loosened as required to provide the desired pivotal or rotational resistance to the newly installed handgrip. This permits the present dual handle attachment 10 to be customized not only for installation upon different types of floor appliances (e.g, vacuum cleaners, large, heavy push brooms, mops, and squeegees, etc.), but also to be customized to provide optimum grip for a person using the present device, depending upon his or her infirmities.

Figure 4:
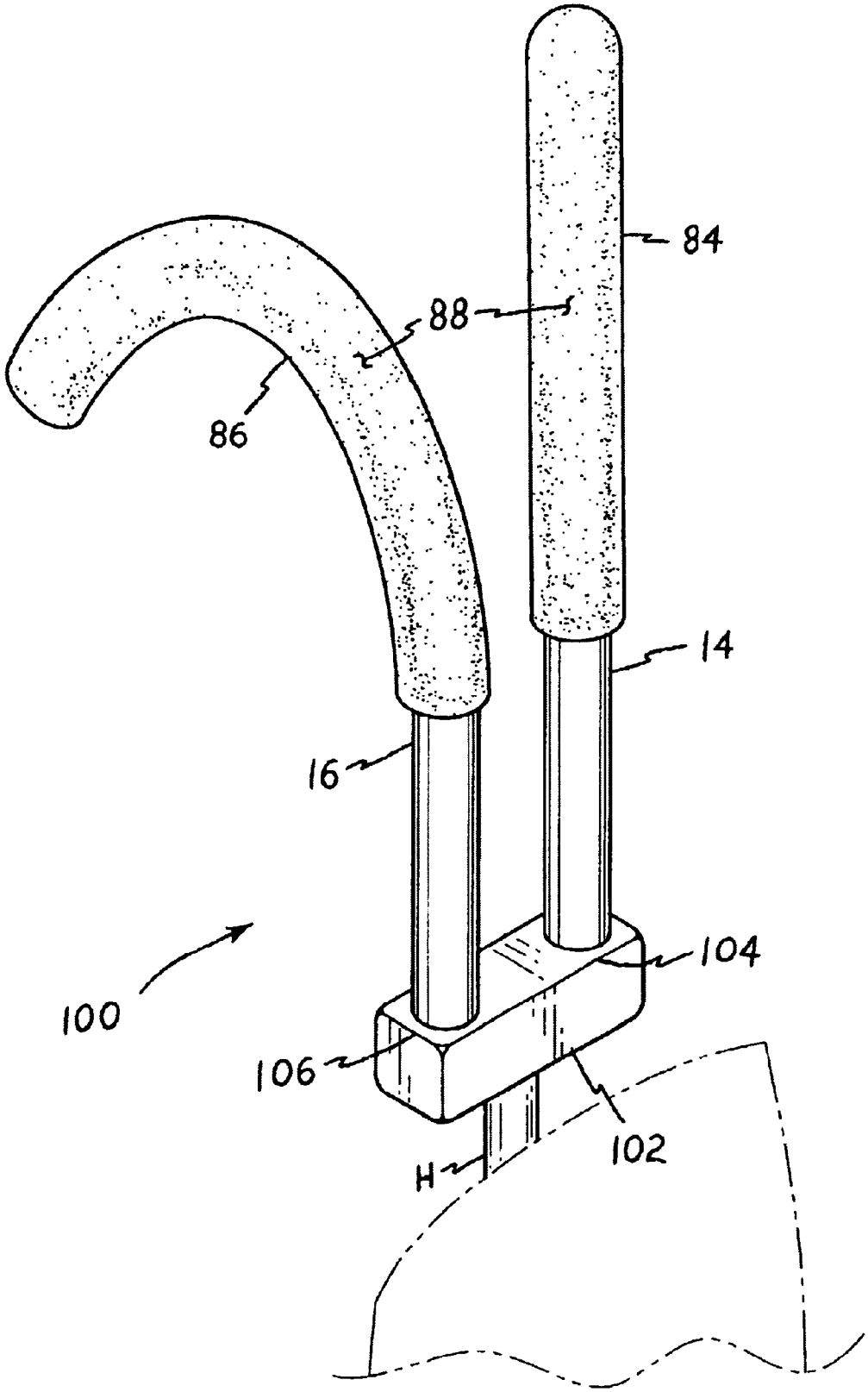
FIG. 4 is a perspective view of an alternative embodiment of the present dual handle attachment, comprising a permanently installed central bracket for the handgrips.

FIG. 4 of the drawings illustrates an alternative embodiment 100 of the present invention, in which the central attachment bracket 102 is permanently secured to the appliance handlebar H as an integral component thereof. The attachment bracket 102 includes all of the various means used for attaching the two handgrips 14 and 16 thereto, as used for attaching the handgrips 14 and 16 to the first clamp portion 18 of the removable clamp assembly 12 illustrated in FIGS. 1 through 3 and discussed further above, i.e., handgrip attachment lugs and passages, handgrip rotation resistance means, and attachment nuts and washers. Most of these components are not shown in FIG. 4, due to the angle of the perspective view. However, it will be understood that the only difference between the dual handle assembly 100 of FIG. 4 and the dual handle assembly of FIGS. 1 through 3, is that the bracket 102 of FIG. 4 is permanently installed (e.g., welded, cast or forged integrally, etc.) with the upper or distal end of the appliance handlebar H, rather than being removable. Thus, the bracket 102 does not include the various clamping components 20 and 26 through 56 illustrated in FIGS. 1 through 3 for the first embodiment 10 of the present invention for removably securing that embodiment to an appliance handlebar H. The remainder of the bracket 102, i.e., the laterally spaced handgrip attachment lugs or portions 104 and 106, are equivalent to the corresponding components 22 and 24 of the first embodiment attachment 10 of FIGS. 1 through 3.

Figure 5:
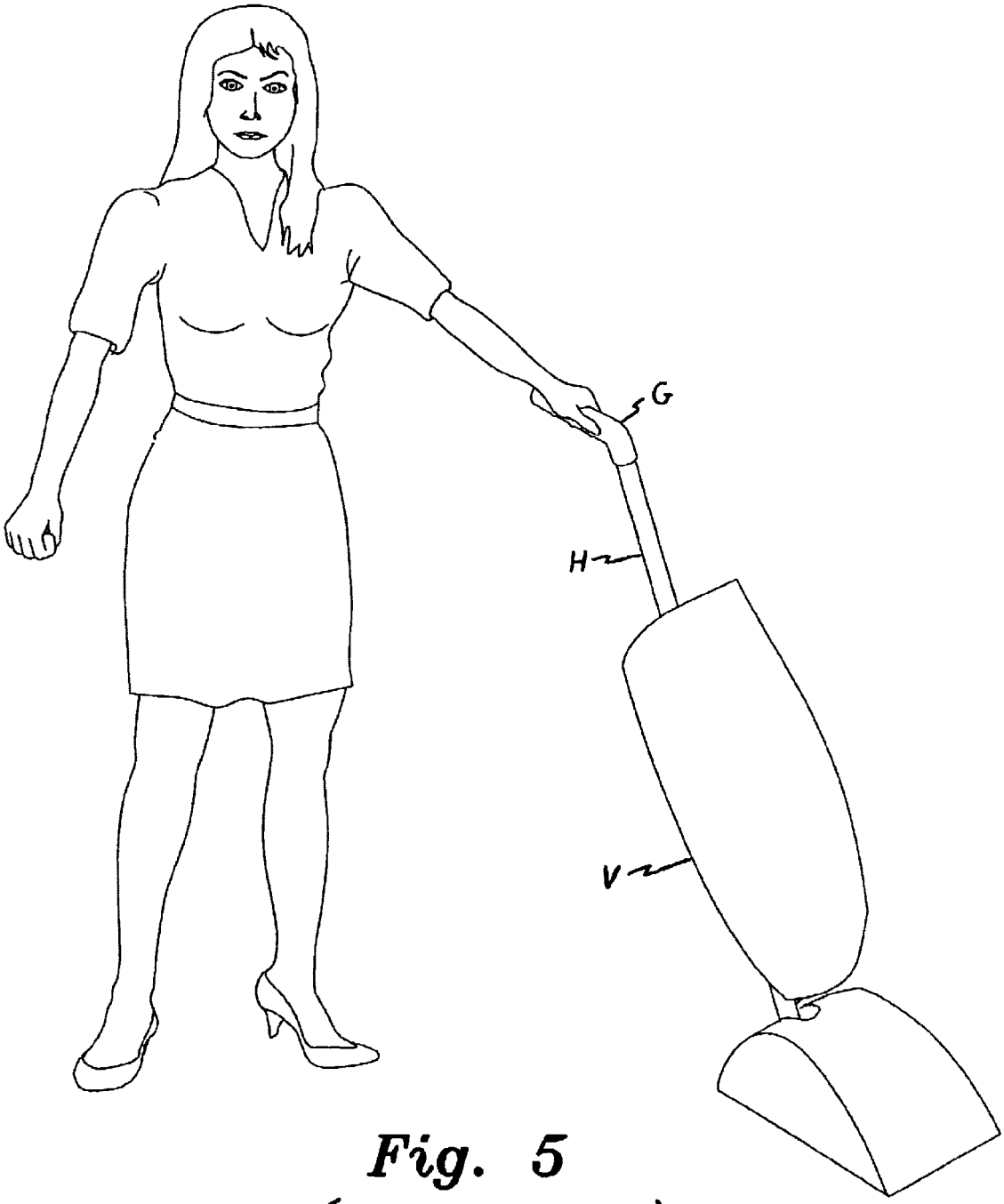
Fig. 5 (Prior Art)
FIG. 5 is a perspective view of a prior art vacuum cleaner having a conventional single handlebar and handgrip, illustrating the asymmetric forces involved in the operation of the appliance.

In conclusion, the present dual handle attachment for an appliance, provides a much needed means for persons of limited strength or mobility to handle otherwise routine household chores. Prior art FIG. 5 clearly illustrates the problems involved in appliances not equipped with one of the embodiments of the present invention. In FIG. 5, a vacuum cleaner V has only a single, central handlebar H with a single handgrip G at its upper or distal end. This requires the operator of the device to use only one hand, which results in twisting of the posture and upper body, and potential aggravation of wounds or injuries.

Moreover, the provision of only a single handgrip G requires a person using such a device to apply all the motive force required using only a single hand, wrist, and arm. For persons with limited upper body strength, for whatever reason, this may be too much to ask. In contrast, the present invention enables such persons to use the strength of both hands, arms, and wrists working in concert with one another, thus requiring only half the strength or force from either side of the body as would be required to manipulate an appliance having only a single handle and handgrip. The ability of the user to operate an appliance equipped with the present invention using symmetrical forces on both handles, also greatly relieves asymmetric stresses and strains upon the torso of the user. The ability to adjust the handgrips of the present attachment to conform to the needs of the user, or to exchange handgrips for handgrips having a different configuration, provides even greater versatility for the present attachment. Accordingly, the present dual handle attachment for appliances will prove to be of great value to many persons who find it difficult to operate a conventional floor appliance.

It is to be understood that the present invention is not limited to the embodiments described above, but encompasses any and all embodiments within the scope of the following claims.

We claim:

1. A dual handle attachment for an appliance handlebar, comprising:

a handlebar attachment bracket;

mutually opposed, left and right handgrip mounting lugs extending laterally from said handlebar attachment bracket;

said left and right handgrip mounting lugs of said handlebar attachment bracket each having a handgrip attachment passage formed therethrough;

each said handgrip attachment passage having a mutually non-concentric and parallel axis therethrough;

a left and a right handgrip, pivotally secured respectively to said left and said right handgrip attachment passage; and each said handgrip having a straight attachment end portion disposed parallel to and laterally offset from one another.

2. The dual handle attachment according to claim 1, further including padding disposed upon each said handgrip.

3. The dual handle attachment according to claim 1, wherein said handlebar attachment bracket is permanently secured to the appliance handlebar as an integral component thereof.

4. The dual handle attachment according to claim 1, wherein said handlebar attachment bracket comprises:

a handlebar clamp first portion;

said mutually opposed, left and right handgrip mounting lugs extending laterally from said handlebar clamp first portion;

a first and a second appliance handlebar clamp jaw disposed between said handgrip mounting lugs, and defining a space therebetween;

mutually parallel, left and right clamp bolts disposed between said handgrip mounting lugs and straddling said first and said second appliance handlebar clamp jaw;

a handlebar clamp second portion;

mutually opposed, left and right clamp bolt mounting lugs extending laterally from said handlebar clamp second portion;

a first and a second appliance handlebar clamp jaw disposed between said clamp bolt mounting lugs, and defining a space therebetween;

said left and right clamp bolt mounting lugs of said handlebar clamp second portion respectively including a left and a right clamp bolt passage formed therethrough, and installing respectively over said left and said right clamp bolt of said handlebar clamp first portion;

a left and a right clamp nut removably secured respectively to said left and said right clamp bolt, removably securing said handlebar clamp second portion to said handlebar clamp first portion about the appliance handlebar; and said left and right handgrip mounting lugs of said handlebar clamp first portion each having one said handgrip attachment passage formed therethrough.

5. The dual handle attachment according to claim 1, further including padding disposed upon said first and said second appliance handlebar clamp jaw of said handlebar clamp first portion and said handlebar clamp second portion.

6. The dual handle attachment according to claim 1, further including at least one secondary handgrip having a different configuration than said left and said right handgrip, for selectively interchanging with said left and said right handgrip.

7. The dual handle attachment according to claim 6, further including:

a threaded attachment stud extending from said attachment end portion of each said handgrip; and an attachment nut removably secured to said attachment stud of each said handgrip.

8. The dual handle attachment according to claim 7, further including a rotational resistance element disposed at said attachment stud of each said handgrip.

9. A dual handle attachment for an appliance handlebar, comprising:

a handlebar clamp first portion;

mutually opposed, left and right handgrip mounting lugs extending laterally from said handlebar clamp first portion;

a first and a second appliance handlebar clamp jaw disposed between said handgrip mounting lugs, and defining a space therebetween;

mutually parallel, left and right clamp bolts disposed between said handgrip mounting lugs and straddling said first and said second appliance handlebar clamp jaw;

a handlebar clamp second portion;

mutually opposed, left and right clamp bolt mounting lugs extending laterally from said handlebar clamp second portion;

a first and a second appliance handlebar clamp jaw disposed between said clamp bolt mounting lugs, and defining a space therebetween;

said left and right clamp bolt mounting lugs of said handlebar clamp second portion respectively including a left and a right clamp bolt passage formed therethrough, and installing respectively over said left and said right clamp bolt of said handlebar clamp first portion;

a left and a right clamp nut removably secured respectively to said left and said right clamp bolt, removably securing said handlebar clamp second portion to said handlebar clamp first portion about the appliance handlebar;

said left and right handgrip mounting lugs of said handlebar clamp first portion each having a handgrip attachment passage formed therethrough;

each said handgrip attachment passage having a mutually parallel axis therethrough; and a left and a right handgrip, pivotally secured respectively to said left and said right handgrip attachment passage.

10. The dual handle attachment according to claim 9, further including padding disposed upon each said handgrip.

11. The dual handle attachment according to claim 9, further including padding disposed upon said first and said second appliance handlebar clamp jaw of said handlebar clamp first portion and said handlebar clamp second portion.

12. The dual handle attachment according to claim 9, further including at least one secondary handgrip having a different configuration than said left and said right handgrip, for selectively interchanging with said left and said right handgrip.

13. The dual handle attachment according to claim 12, further including:

a threaded attachment stud extending from said attachment end portion of each said handgrip; and an attachment nut removably secured to said attachment stud of each said handgrip.

14. The dual handle attachment according to claim 13, further including a rotational resistance element disposed at said attachment stud of each said handgrip.

15. A dual handle attachment for an appliance handlebar, comprising:

a handlebar attachment bracket, permanently secured to the appliance handlebar as an integral component thereof;

mutually opposed, left and right handgrip mounting lugs extending laterally from said handlebar attachment bracket;

said left and right handgrip mounting lugs of said handlebar attachment bracket each having a handgrip attachment passage formed therethrough;

each said handgrip attachment passage having a mutually non-concentric and parallel axis therethrough;

a left and a right handgrip, pivotally secured respectively to said left and said right handgrip attachment passage; and each said handgrip having a straight attachment end portion disposed parallel to and laterally offset from one another.

16. The dual handle attachment according to claim 15, further including padding disposed upon each said handgrip.

17. The dual handle attachment according to claim 15, further including at least one secondary handgrip having a different configuration than said left and said right handgrip, for selectively interchanging with said left and said right handgrip.

18. The dual handle attachment according to claim 17, further including:

a threaded attachment stud extending from said attachment end portion of each said handgrip; and an attachment nut removably secured to said attachment stud of each said handgrip.

19. The dual handle attachment according to claim 18, further including a rotational resistance element disposed at said attachment stud of each said handgrip.

* * * * *